United States Patent [19]

Tarassoff

[11] Patent Number: 4,741,272

[45] Date of Patent: May 3, 1988

[54] OVERHEAD CABLE CLAMP AND TRANSPORT SYSTEM USING THE CLAMP

[75] Inventor: Serge Tarassoff, Seyssinet Pariset, France

[73] Assignee: Pomagalski SA, France

[21] Appl. No.: 856,574

[22] Filed: Apr. 25, 1986

[30] Foreign Application Priority Data

Apr. 25, 1985 [FR] France ..... 85 06323

[51] Int. Cl.[4] ..... B61B 9/00

[52] U.S. Cl. ..... 104/173.1; 104/211; 104/216; 104/202

[58] Field of Search ..... 104/173.1, 173.2, 180, 104/202, 204, 211, 216, 224

[56] References Cited

U.S. PATENT DOCUMENTS

| | | | |
|---|---|---|---|
| 474,249 | 5/1892 | Hewitt | 104/211 |
| 3,218,988 | 11/1965 | Gaston et al. | 104/211 X |
| 4,403,552 | 9/1983 | Kunczynski | 104/216 X |
| 4,509,430 | 4/1985 | Creissels | 104/173.1 |

FOREIGN PATENT DOCUMENTS

| | | | |
|---|---|---|---|
| 187552 | 7/1986 | European Pat. Off. | 104/173.1 |
| 861710 | 1/1953 | Fed. Rep. of Germany | 104/202 |
| 1572239 | 5/1969 | France | 104/216 |

*Primary Examiner*—James B. Marbert

*Attorney, Agent, or Firm*—Fred A. Keire

[57] ABSTRACT

A disconnectable locking clamp disconnectable from an overhead cable onto which it is locked, the clamp having a body with a fixed jaw and a movable jaw and in which the support surface (11) of the fixed jaw (3) has, on the one hand, a first cylindrical surface (14) complementary to a corresponding surface (15) of the cable, and, on the other hand, the end (6) of the fixed jaw (3) has a second surface (16) which is an extension of the first surface (14) and which is spaced from a corresponding surface (17) of the cable.

The invention also covers methods of disconnection, connection, and uncoupling of such a clamp, and a transport or towing installation using such a clamp.

19 Claims, 5 Drawing Sheets

OVERHEAD CABLE CLAMP AND TRANSPORT SYSTEM USING THE CLAMP

This invention relates to a cable clamp for a towing or transport installation with a towing/carrying overhead cable, a method of connecting/disconnecting such a clamp to/from the cable, and an overhead cable towing or transport installation, in particular such an installation with two overhead cables.

A disconnectable clamp is already known (European Patent No. 0056919) for an overhead cable transport installation consisting of a clamp body, a fixed jaw which is part of the clamp body with an articulated mobile jaw on the fixed jaw. Normally such a clamp is closed and coupled onto the cable, under the action of an elastic component such as a spring, i.e. it is locked onto the cable. Due to a connection/disconnection rail on which a roller is fitted which travels and is carried by the clamp, the clamp can be unlocked, in opposition to the aforementioned spring and is then disconnected from the cable.

In this known clamp, the internal bearing surfaces of the jaws are of semi-cylindrical or almost semi-cylindrical shape so that in the locked condition the two jaws clamp the cable totally or almost totally. The clamp grips the cable from above and the ends of the jaws are level with the lower surface of the cable (see FIG. 1).

An installation is also known (European Patent No. 0093680) which has two towing-carrying cables parallel to each other but transversely spaced apart. The clamps with which this installation is provided are of the type mentioned above or similar. The installation has embarking/disembarking or loading/unloading end stations provided with carriage travelling rails on which the clamps are mounted, one or more clamp connection and disconnection rails, one or more travelling rails for the vehicles or the carriages which carry them, and the means for deviating the trajectory of the cables relative to those of the travelling rails.

These end stations in general consist of two separate areas: a vehicle arrival area and a vehicle departure area.

In the area where the vehicles arrive in the stations, the clamps are disconnected from the cables to permit, for example, parking of the embarkation/de-embarkation vehicles or loading/unloading of the passengers or goods on stopping or at reduced traffic speed considerably lower than the cables' travelling speed. For this purpose the vehicles are disconnected from the cables and travel on guide rails or other suitable tracks.

In the departure area, the opposite takes place so that the vehicles can be put into circulation or the load of passengers or goods respectively embarked when the vehicles are stopped or are moving at a reduced speed of travel considerably below the speed of travel of the cable. The vehicles are engaged with the cables by the clamps.

In these installations, and with these known clamps, a problem which arises is that of the connection or disconnection of the clamp in relation to the cable. During the disconnection phase, the clamp which was previously connected to the cable is, on the one hand, released and, on the other hand, spaced from it and no longer interacts with it. In the course of the connection phase the opposite occurs.

The fixed jaw has an internal bearing surface of a generally semi-cylindrical shape which remains substantially in contact with the cable even when the clamp is in the opened condition and it follows that, to extract the cable from the clamp, it is necessary to make a combined double movement of the cable in relation to the clamp, on the one hand, horizontally and transversely (i.e. normal to the central part of the surface of the internal part of the fixed jaw) which has the effect of spacing the cable and the fixed jaw, and, on the other hand, vertically (i.e. in the ingoing or outgoing direction of the clamp) until the cable egresses entirely from the internal space outlined by the clamp jaws. In this situation, the cable is disposed at the clamp's entry gap. Due to a further cable/clamp related movement which is essentially horizontal and crosswise, it is possible to distance the clamp from the cable completely thus avoiding all interaction between them.

In one station, the departure/arrival area having the connecting/disconnecting rails, the cables, the travelling rails, the deviating means of deviation, is formed of several areas: a locking/unlocking area, a coupling/uncoupling area, and a catching/releasing area. In the locking/unlocking area, each of the clamps passes progressively from the fully locked state to the fully unlocked state; in the coupling/uncoupling area, a displacement of the clamp in relation to the cable frees the clamp from the cable following which no further contact exists between the clamp and the cable, the clamp then being disposed around and near the cable, or, conversely, the clamp is engaged with the cable by this relative movement of the clamp in relation to the cable which establishes the contact between the clamp and the cable; in the catching/releasing area, the clamp is in the totally unlocked condition without surrounding the cable and is moved closer to or further from the cable, as well as the vehicle with which it is associated.

The means of deviation relating to the trajectory of the cables in relation to that of the travelling rails are thus disposed in the coupling/uncoupling area and in the catching/releasing area.

In view of the foregoing, it follows that in the coupling/uncoupling area the means of deviation must provide the horizontal and vertical relative double movement. This leads among other things to the locating in the coupling/uncoupling area of wheels supporting the cables in sloping disposition. In the case of a two-cable installation as described in the aforementioned Patent No. 0093680, it is to be noted that in the coupling/uncoupling area, not only is there a relative vertical movement of the cable in relation to the clamp, but also a relative horizontal movement, which is translated by the fact that the two cables move, becoming more distant from each other, from the locking/unlocking area to the catching/releasing area. These deviations of the cable pose numerous problems and in particular that of adjustment and stress. It can of course be understood that it is particularly arduous to adjust a double deviation relating to the trajectory (horizontal and vertical) between the cable and the travelling rail, all the more so as this deviation occurs in short distances. It is also to be understood that the cable and the support wheels with inclined axes suffer unusual stresses which it would be desirable to avoid.

The invention therefore aims at obviating or mitigating these problems.

According to this invention there is provided a disconnectable locking clamp for use with a carrier/towing cable for a transport installation having at least one overhead carrier/towing cable, to lock a vehicle rigidly to the cable from above, the clamp comprising a body mounting a fixed jaw and a movable jaw, the clamp being either normally in the connected position where it is rigidly locked with the cable from above, the jaws being flush with the lower surface of the cable in locked position and presenting a small arch or projection relative to the upper part of the cable, or in the disconnected condition when it is no longer rigidly locked with the cable, the jaws then being in the unlocked position, and the clamp being characterised in that the internal support surface of the fixed jaw consists, on the one hand, of a first cylindrical surface complementary to the cross-sectional shape of the cable so that, in the locked condition, the first surface contacts a first corresponding surface of the cable and, on the second hand, at the side of the end of the fixed jaw a second surface which is an extension of the first cylindrical surface and which, in the locked condition is spaced from a second corresponding surface of the cable.

Preferably, said second surface of the fixed jaw is, at least partly approximately flat, and is spaced from the second cable surface at least as much as a plane tangential to said second cable surface and which is preferably located in said plane.

Preferably, the first cylindrical surface of the fixed jaw is an arc of approximately 90°.

Preferably, the internal support surface of the movable jaw is of cylindrical section shape and is complementary to the cross section of the cable, extending through an arc of between 90° and 180°, preferably between 120° and 150° so that in the locked condition the movable jaw contacts the adjacent cable surface,t he gap between the end of the movable jaw and the end of the fixed jaw being, in the locked condition, below a median diameter of the cable.

The invention also proposes a method of connecting two clamps respectively to each of the cables of a transport installation with two overhead cables parallel to each other and driven at the same speed in which the cables are inserted in the internal spaces of the clamps, the clamps are coupled to the cables, then each of the clamps is locked round the cable by firstly causing the movable jaw to contact the side surface of its respective cable, and then urging the cable against the fixed jaw thus imposing a transversal approach of the two cables; a method of disconnecting at least two clamps which lock a vehicle to the cables of a transport installation with two overhead cables, the clamps having been previously connected to the cables by the aforesaid method, in which disconnection method, when the clamps are unlocked and the movable jaw is spaced from its respective cable following which both cables return resiliently to their normal spacing imposed by the fixed structure of the installation which is slightly greater then the transverse gap between the clamps, and thus creates a spacing between, on the one hand, the cables, and on the other hand, the fixed jaws and the clamps.

The invention also proposes a carrying/towing overhead cable transport installation having a clamp according to the invention and permitting the carrying out of the aforesaid methods; and a transport installation with two overhead cables parallel to each other in which the horizontal and transverse gap between the clamps is slightly less than that of the cables.

Thus the invention solves, due to the shape of the fixed jaw and/or the fact that the clamp gap is slightly less than that of the two cables, the problem of the double movement of the cable(s) in relation to the clamp(s) in the coupling/uncoupling area. According to the invention, there is only a vertical movement, not requiring the fine adjustment necessary for a horizontal movement. This makes it possible in particular to avoid the use of the sloping shaft rollers and the technical difficulties of control arising from this.

An embodiment of the invention will now be described, by way of example, with reference to the accompanying drawings, in which.

Figure 2:
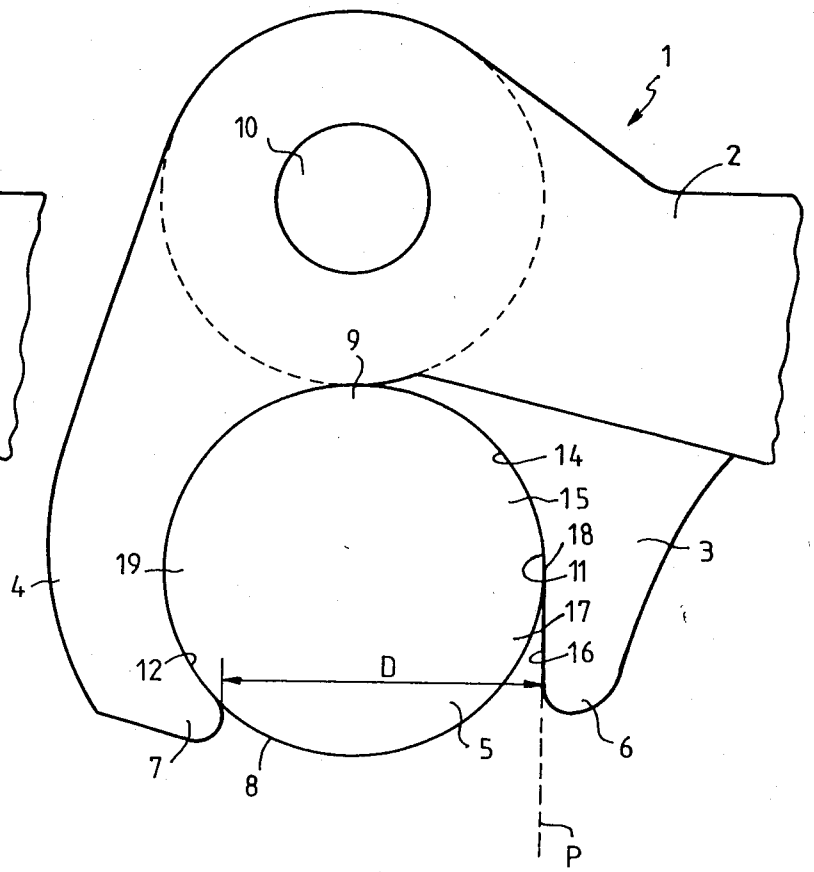
FIG. 2 is a diagrammatic elevation of a clamp according to the invention in the closed position.
Figure 1:
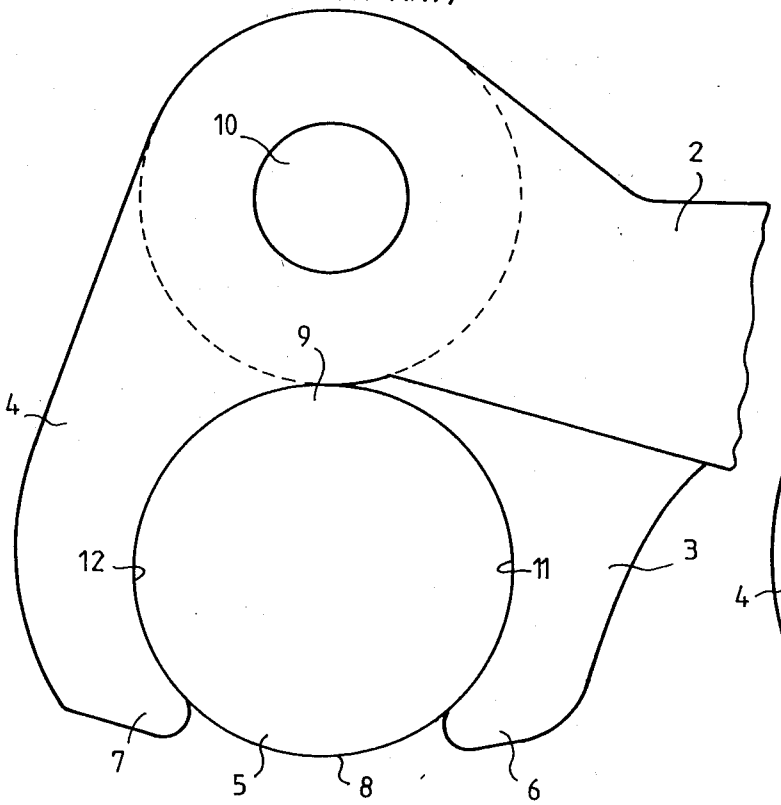
FIG. 1 (PRIOR ART)
FIG. 1 is a diagrammatic elevation of a known clamp in the closed position.

A clamp 1 according to the invention comprises a body 2 and two jaws, one fixed, indicated at 3 and the other movable indicated at 4 and which is normally in the locked condition when the clamp grips the top of a cable 5 of substantially circular cross section, the jaws being directed downwards and gripping the sides of the cable. The two jaws 3 and 4 have, in a known manner, two ends 6 and 7 respectively, which are flush with the lower surface 8 of cable 5 when in the closed position in order to permit passage of cable 5 over supporting rollers without jerking, and present a small projection on the upper part 9 of cable 5 which does not obstruct passage under compression rollers. Movable jaw 4 is pivoted in a known manner on an axis 10 supported by the body 2 which, in the connected state, extends parallel above cable 5. Each jaw 3, 4 has an internal support surface 11, 12, these surfaces defining an internal space 13 of the clamp 1. In the locked condition the cable 5 is contained in the internal space 13 and surfaces 11, 12 are at least partly in contact with the cable 5.

The internal support surface 11 of the fixed jaw 3 of a clamp according to the invention consists, on the one hand, of a first part 14 resting on the cable 5 and in the form of a cylindrical section complementary to the section of the cable 5 so that in the closed condition, the first part 14 embraces with a first arcuate section 15 of the cable 5 in question, and, on the other hand, at the side of the end 6, a second part 16 which is an extension of the first part 14 and which, in the closed condition, is spaced from a second arcuate section 17 of the cable. This second part 16 is at least partly approximately flat. It is at least as far from the second arcuate section 17 as is a plane P tangential to the first part 14 at its junction 18 with the second part 16. Preferably, this second part 16 is at least partly and approximately disposed in plane P, i.e. as shown in FIG. 2, substantially flat and disposed in plane P.

According to the invention, the first cylindrical part 14 supported on the cable 5 extends through approximately 90°. This cylindrical part is at best a maximum of 90°, but can be less than 90°, in which case the second part 16 is spaced further from the second section 17 than the plane P. However, the gap D between the ends 6 and 7 when the clamp is closed is less than the diameter of the cable 5, so that the cable cannot escape from the internal space 13 of the clamp 1.

Further, the internal support surface 12 of the movable jaw 4 is cylindrical and complementary to the section of the cable 5 so that in the closed condition, the whole of the movable jaw mates with a cylindrical surface 19 of the cable. This internal cylindrical support surface 12 extends between 90° and 180° and preferably is between 120° and 150°. Thus, the clamp 1, in the closed condition, grips the cable 5 over a cylindrical surface less than 270° but greater than 180°, and preferably between 210° and 240°. Further, internal support surfaces 11, 12 merge, in the closed condition, at the upper part 9 of the cable to ensure that this upper part 9 of the cable is also gripped by the clamp. The two surfaces 11, 12 thus mate with a cylindrical section of cable formed of surfaces 12 and defining a continuous cylindrical surface extending between 210° and 240°.

It is thus to be understood that the end 6 of the fixed jaw 3 spaced from the cable 5 does not lock it in the internal space 13, and when the movable jaw 4 is in the open position, the cable 5 can be moved vertically out of the internal space 13.

In order to facilitate understanding of the rest of the description, we define with reference to the cable 5 three basic directions: the longitudinal horizontal direction, the transverse horizontal direction and the vertical direction. The longitudinal horizontal direction is the direction of the axis of the cable 5. It will be noted that this direction is not, in practice, always horizontal, although it is referred to as longitudinal horizontal for purposes of simplicity, as it can be more or less sloped in relation to the horizontal depending on the path of the cable,t his path depending, in particular, on features of the terrain and/or the function to be fulfilled by the transport or towing installation in question. The transverse horizontal direction is the direction which is absolutely horizontal and perpendicular to the axis of cable 5. These two directions define a plane referred to as horizontal even though in practice this plane is not always truly absolutely horizontal, only the transverse horizontal direction being absolutely horizontal. The vertical direction is the direction perpendicular to this plane.

For example, in the case of an installation with two carrying/towing cables, the horizontal plane is the plane containing the two cables.

Thus, in practice, this plane is either effectively horizontal if the longitudinal horizontal direction is actually horizontal or sloped more or less according to fetures of the terrain and the trajectory or path of the cables.

The invention also covers a method of disconnecting a clamp from the cable, i.e. a method making it possible to unlock a clamp from the locked condition gripping the cable, then to separate the clamp from the cable by removing all contact between the clamp and the cable and finally to release the cable from the clamp in such a way that the clamp and the cable are completely free of each other and can no longer interact. Conversely, a method for connecting a clamp to a cable makes it possible to engage the cable in the internal space of the clamp so that they can interact, to associate the cable with the clamp by establishing contact between the cable and the clamp, and then to close the clamp round the cable to rigidly lock the clamp to the cable.

The method, according to the invention, for disconnecting a clamp 1 from a cable 5, consists, in known manner, of firstly unlocking the clamp 1 by relatively pivoting jaws 3 and 4 apart from the locked condition; secondly uncoupling the clamp 1 from the cable 5 so that all contact between cable 5 and clamp 1 is removed, the cable 5 still however being within the internal space 13 of clamp 1 at the end of this uncoupling phase, but being able to move at a speed different from the forward speed of the clamp 1 which can, if necessary, be completely at rest; and thirdly releasing the cable 5 from the clamp 1 when the cable 5 is spaced from the clamp 1, outside the internal space 13 so that they can no longer interact. In this method, according to the invention, during the second and uncoupling phase, the cable 5 is moved in relation to clamp 1 only in the vertical direction. Due to the shape of the clamp 1, it is not necessary to effect relative movement in the transverse horizontal direction between the cable 5 and the clamp 1 to separate them. This is due to the fact that the fixed jaw 3 has the internal support surface 11 whose second part 16 and thus the end 6 of this fixed jaw 3 is spaced from the cable.

This is why the invention covers more especially a method of separating a cable from an overhead cable towing or transport installation from a disconnectable clamp which, in the locked or connected condition, allows a vehicle or similar to be connected to this cable, and in which the clamp is mainly moved vertically and upwards and the cable is left with a straight trajectory or path.

The invention is more especially suitable for a disconnectable overhead cable transport or towing installation having at least one tensioned continuously moving towing-carrier cable 5 supported and guided by compression support and/or guide rollers 22; at least one vehicle or similar with which is associated a carriage 21 and a suspension 20, at least one clamp having a clamp body 2 and two jaws 3 and 4, the clamp being normally in the locked condition where it overlies and grips the cable 5, jaws 3 and 4 being preferably flush with the lower surface of the cable 5, i.e. in the disconnected condition when it is no longer interlocked rigidly with the cable 5 and the jaws 3 and 4 are in the open position; embarkation and/or disembarkation (loading/unloading) stations where there is firstly a combination of at least one clamp connection/disconnection rail 23, secondly at least one travelling rail 24 for the carriage 21, which can cooperate with at least one travelling roller 31 carried by the clamp or the carriage 21, defining a clamp unlocking/locking area 25, a clamp coupling/uncoupling area 26, a catching/releasing area 27, and thirdly means 28 for deviating the trajectory of the cable 5 relative to that of the travelling rail(s) 24, in the coupling/uncoupling area 25 and in the catching/releasing area 27.

An installation according to the invention has a clamp 1 according to the invention as described above.

Figure 4:
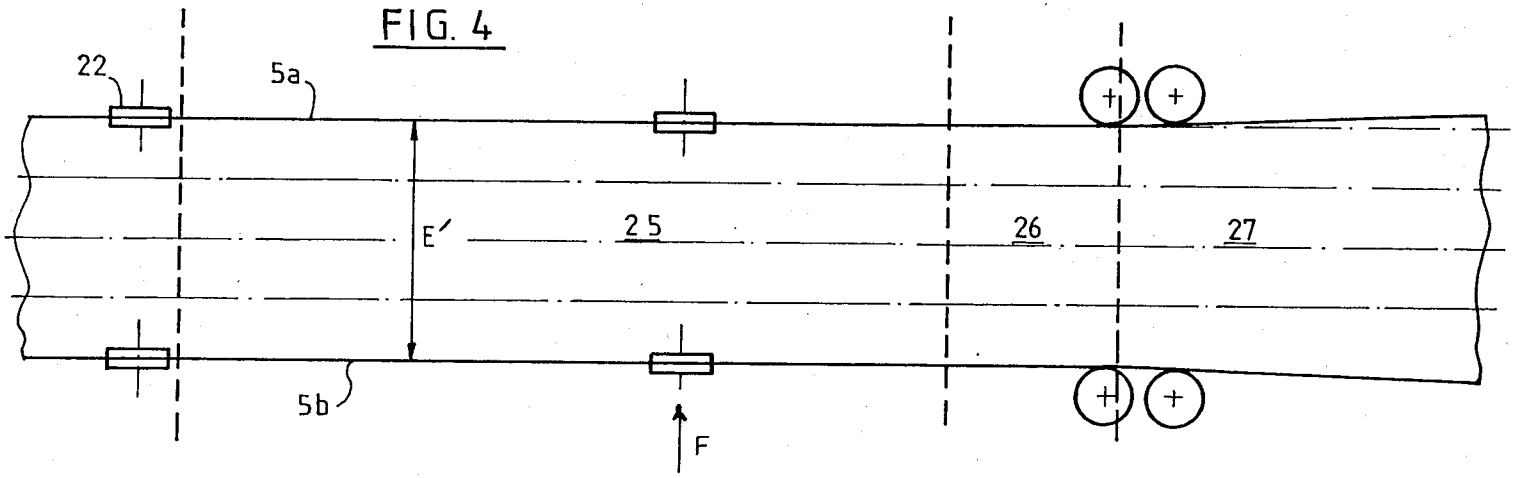
FIG. 4 is a diagrammatic plan view of the cables at a departure/arrival area of an end station of the transport installation.
Figure 5:
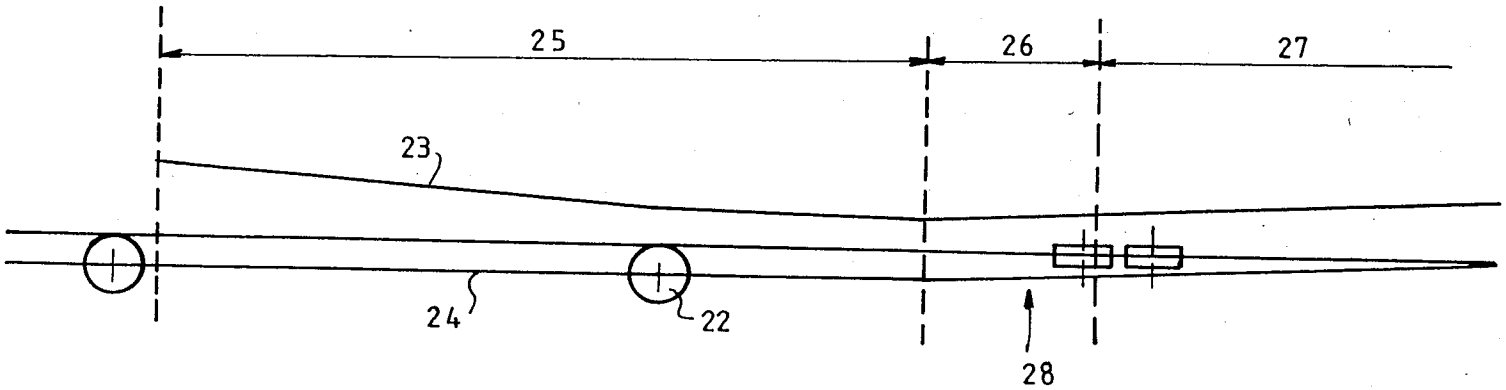
FIG. 5 is a diagrammatic side view of the cables in the direction of the arrow F of FIG. 4.

The various areas 25, 26, 27 have been represented in FIGS. 4 and 5 where they are bordered by dotted lines. However, these areas 25, 26 and 27 are operational areas which are not always necessarily of the shape shown in FIGS. 4 and 5. These areas are moreover not always necessarily physically separate and can overlap.

In the unlocking/locking area 25, the connection/disconnection rail 23 cooperates with at least one control roller 29 carried by the clamp 1 or the carriage, and which in combination with an elastic component such as spring 30 controls the locking/unlocking of the movable jaw 4. In this area at least one part of cable 5 is in contact with clamp 1.

In fact, whether clamp 1 is in the unlocked or locked condition, the upper part 9 of the cable is in contact with the clamp due to the fact that clamp 1 has not deviated in this unlocking/locking area.

In the coupling/uncoupling area 26, the means of deviation 28 acts in the vertical direction. On coupling, the means 28 vertically brings the clamp 1 which is in the unlocked condition near to the cable 5, which is already positioned in internal space 13 of clamp 1, until contact is established between clamp 1 and the upper part 9 of cable 5. Conversely, on uncoupling, the means 28 vertically separates the clamp 1 which is in the unlocked state from cable 5, removing all contact between clamp 1 and cable 5.

At the end of the uncoupling phase, the cable 5 is situated in the internal space 13 of clamp 1 and thus the vehicle is not yet totally disconnected.

In the catching/releasing area 27, the clamps are also in the open position and the means of deviation 28 acts in the transverse horizontal direction and/or in the vertical direction. On catching, the cable 5 is inserted into internal space 13 of the clamp 1. On releasing, the cable 5 and clamp 1 are sufficiently spaced from one another not to interact and to permit total disconnection of the vehicle.

In an overhead transport or towing installation according to the invention, the means of deviation 28 is produced by the specific shape of the trajectories or paths of the cable 5 and the travelling rail(s) 24.

Thus, in the coupling/uncoupling area 26, in order to produce the means of deviation 28, the trajectory of the cable 5 and the trajectory of travelling rail(s) 24 slope in relation to each other in the vertical plane. For example if travelling rail(s) 24 is/are located below the cable 5, the trajectory is similar to the trajectory of cable 5 in the vertical direction of coupling/uncoupling area 27. Further the trajectories of cable 5 and of travelling rail(s) 24 remain at a constant or relatively constant distance in the transverse horizontal direction, in coupling/uncoupling area 26. In coupling/uncoupling area 26, the axes of the support, compression and or guide rollers 22 of cable 5 are on the transverse horizontal plane or approximately so. Preferably the cable 5 is almost undeviated from its trajectory in the coupling-/uncoupling area 26, the travelling rail(s) being deviated in the vertical direction from its/their initial longitudinal horizontal trajectory. In coupling/uncoupling area 26, the travelling rail(s) has/have a trajectory which is not parallel to that of cable 5.

The invention also proposes a transport or towing installation having, in known manner, two overhead carrying-towing cables 5*a* and 5*b*, which are parallel to each other and driven at the same continuous speed thanks to end stations, pylons, support, compression and/or guide rollers, at least one vehicle or similar coupled by a suspension 20 extending in the vertical plane of symmetry of the cables and articulated to a carriage 21 bearing at least one pair of disconnectable clamps to interlock carriage 21 to the two cables and to uncouple the vehicle within the end stations by disconnection of the clamps, so as to permit storage of the vehicle(s) or the embarkation/debarkation or loading-/unloading of passengers or goods respectively.

Figure 3:
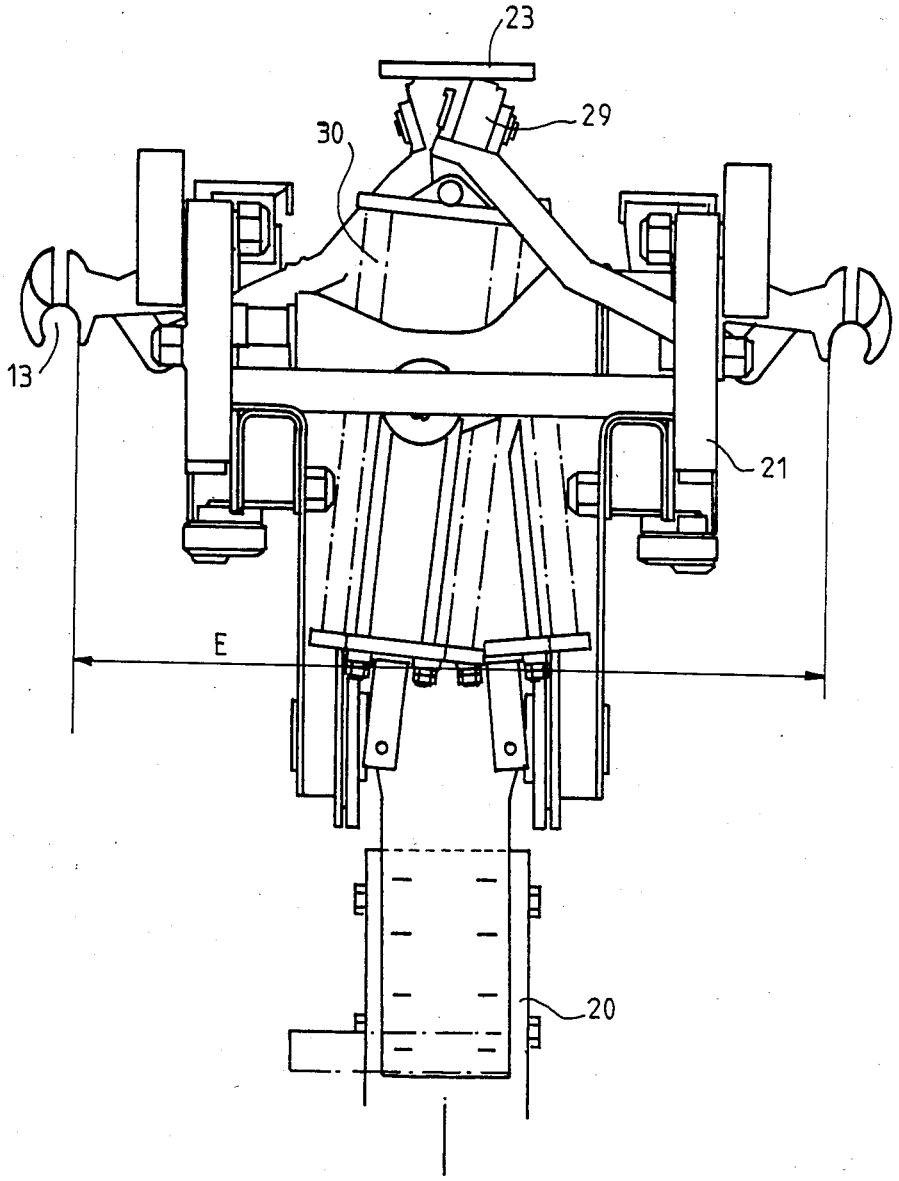
FIG. 3 is an elevation of a carriage with at least two clamps according to the invention for use in an overhead transport installation having two cables.

In general, the fixed jaws 3 are situated towards the inside of the carriage, the movable jaws being towards the outside in relation to the fixed jaws. Thus the movable jaws 4 enclose in the closed condition the external side parts 32 of the cables 5*a*, 5*b*, i.e. those which are orientated towards the outside of the two cables, adn the fixed jaws 3 enclose in the locked condition the internal side parts 33 of the cables 5*a* and 5*b* facing the space separating the two cables. This installation, according to the invention, is such that transversal horizontal gap E (FIG. 3) between the two cables inserted in the clamps in the locked and connected condition is less than the normal horizontal and transversal gap E′ between the two cables 5*a* and 5*b* imposed by the fixed structore of the installation (pylons, support, compression and/or guide rollers, and end stations). Gap E corresponds to the gap between the internal support surfaces of the fixed jaws 3 of the clamps. This gap does not perfectly match that between the cables, being smaller, in particular slightly smaller than the gap between the cables. Thus, when one closes the clamp by locking the movable jaw 4, the cables 5*a* and 5*b* approach each other transversely at the inside of the spaced clamps and suffer a slight elastic deformation.

It can thus be understood that the cables are separated from the fixed jaws as soon as the clamps are opened, as they come back automatically to their initial state, and only a vertical movement of the clamps in relation to the cables is needed to separate them.

A two-cable installation according to the invention also has at least one locking/unlocking area 25, at least one coupling, uncoupling area 26, and at least one catching/releasing area 27 as described above.

The structure of the installation (pylons, support, compression and/or guide rollers, and end stations) is arranged in such a way that in the coupling/uncoupling area of a two-cable installation according to the invention, the transverse horizontal gap between the two cables 5*a* and 5*b* is constant or approximately constant. This gap between the two cables is only eentually modified by the fixed structure in the catching/releasing area. In fact, it is not necessary to modify this gap to separate the cables from the clamps, as the cables separate from each other and the fixed jaws automatically come back to their initial gap E′ when the clamps open.

Of course, this arrangement is all the more efficient if the clamps are clamps 1 according to the invention as described above, but this is not necessary for such an arrangement makes it possible to separate known clamps without horizontal deviation of the cables.

The spatial relationship between transverse gap E and transverse gap E′ should preferably be greater than 99% and at most equal to 100%. In fact gap E should not be too small since cables 5*a* and 5*b* must always pass through support, compression and/or guide rollers 22. The gap difference is thus such that it does not obstruct the run of the cables and the travel of the clamps to the right of the pylons. This is why this difference in gap is very small. For example, the distance separating the lateral part of a cable in relation to the fixed jaw corresponding to the internal support surface of the fixed jaw when the clamp is open, should preferably be between 1 and 5 mm. In this case, the difference between gap E of the cables when inserted in the clamps and gap E′ of the cables when free is between 2 and 10 mm.

A method according to the invention of connecting at least two clamps respectively to each of cables 5*a* and 5*b* of a transport installation with two overhead cables according to the invention has a catching stage when one inserts the clamps between two cables 5*a* and 5*b* spaced so that the plane of the clamps is situated above the horizontal plane of the cables, the vehicle or similar supported by the clamps being situated below the plane of the cables; then one effects a change of position of the cables relative to the clamps in the horizontal direction and in the vertical direction to insert the cables in internal space 13 of the clamps, the side surfaces of the cables then not being in contact with the fixed and mobile jaws; a coupling stage when the position of the cables is changed in relation to the clamps in the unlocked condition in the vertical direction to couple the clamps with the cables establishing the contact between the clamps and the upper part 9 of cables 5*a* and 5*b;* a locking stage when each of the clamps is locked round the corresponding cable in two stages; an initial stage when the internal support surface 12 of the movable jaw 4 of each of the clamps comes into contact with the side surface 32 of the corresponding cable and a second stage when the movable jaw 4 places this cable against the fixed jaw 3 imposing a slight change of position of the cable in relation to this fixed jaw 3 in the transverse horizontal direction, and thus a slight transverse horizontal coming together of the two cables 5*a* and 5*b,* the clamps then being rigidly interlocked with the cable(s). In the second stage the side surface 33 of the cable in relation to the fixed jaw comes into contact with internal support surface 12 of this fixed jaw.

Figure 6:
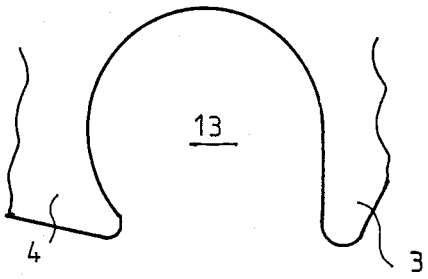
FIGS. 6 to 10 diagrammatically illustrate the various phases of the connection/disconnection of a clamp according to the invention with a cable.
Figure 6:
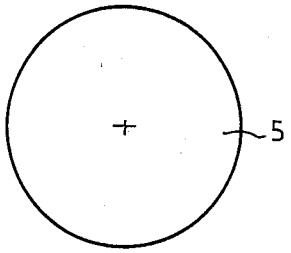

FIG. 6 illustrates the respective positions of a cable and a clamp before the catching phase.

Figure 7:
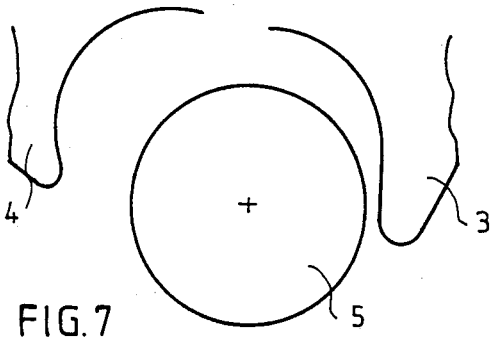
Figure 8:
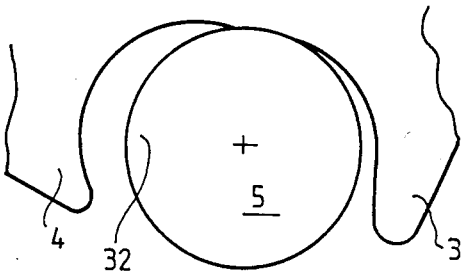
Figure 9:
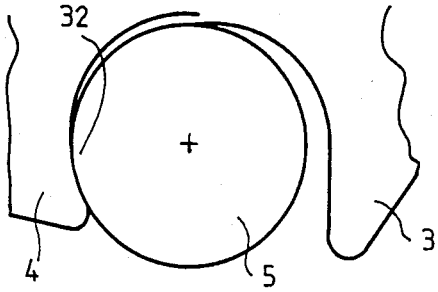
Figure 10:
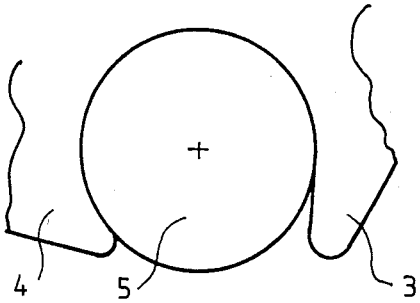
Figure 11:
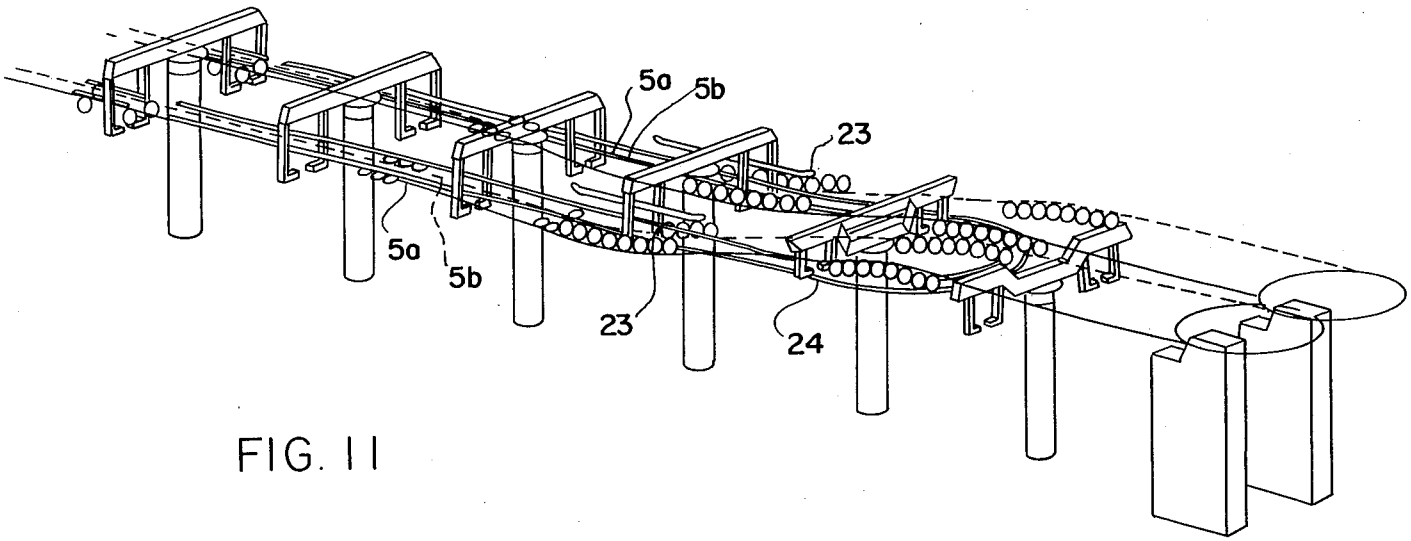
FIG. 11 is a diagrammatic perspective view illustrating an end station of an installation according to the invention.

FIG. 7 illustrates the respective positions of a cable and a clamp after the catching phase and at the beginning of the coupling phase. FIG. 8 illustrates the respective positions of a cable and a clamp after the coupling phase. FIG. 9 illustrates the respective positions of a cable and a clamp at the end of the first stage and at the beginning of the second stage of the gripping phase. FIG. 10 illustrates the respective positions of a cable and a clamp at the end of the second stage of the gripping phase.

A method according to the invention to disconnect at least two clamps locking one vehicle rigidly in relation to each of the cables of an overhead transport cable according to the invention, the clamps having been previously connected to the cables by a method according to the invention, has a phase of unlocking the clamps from the locked state where they are rigidly interlocked with the cables when the movable jaw 4 is removed from each of the clamps of the corresponding cable, following which both cables resiliently return to their normal transverse horizontal gap E′ imposed by the fixed structure of the installation (pylons, end stations, support and compression and/or guide rollers) which is slightly greater than the transverse gap of the clamps and thus slightly distances both from each other and from the fixed jaws 3 of the clamps. This method according to the invention finally has an uncoupling phase and release phase as described above.

This method according to the invention is illustrated by FIGS. 10, 9, 8, 7 and 6.

The invention can have numerous modifications, in particular, in the reverse case, where the fixed jaws 3 are located outside the movable jaws 4, it is, on the contrary, the gap E′ between the cables when free which is less than the gap E between the cables when inserted and locked in the clamps and when the clamps are locked, the two cables being spaced from each other.

I claim:

1. A disconnectable locking clamp for use with a carrier/towing cable for a transport installation having at least one overhead carrier/towing cable for locking a vehicle rigidly to the cable from above, the clamp comprising a body having a fixed jaw and a movable jaw pivotally connected to the fixed jaw, said clamp being operable between a normally locked connected condition where it is rigidly locked with the cable from above and the jaws are flush with the lower surface of the cable and present a small projection relative to the upper part of the cable and a second disconnected condition wherein it is not locked with the cable, and the jaws are unlocked and disengaged from the cable, and said fixed jaw having an internal support surface including a first cylindrical surface complementary to the cross-sectional shape of the cable whereby in said locked condition the first surface contacts a first corresponding surface of the cable and a second surface which is an extension of the first cylindrical surface and which, in the locked condition is spaced from a second corresponding surface of the cable.

2. A clamp according to claim 1, in which said second surface of the fixed jaw is, at least partly approximately flat, and is spaced from the second cable surface at least as much as a plane tangential to said second cable surface and which is preferably located in said plane.

3. A clamp according to claim 1, in which the first cylindrical surface of the fixed jaw is an arc of approximately 90°.

4. A clamp according to claim 1, in which the movable jaw has an internal support surface of cylindrical section shape which is complementary to the cross-section of the cable, extending through an arc of between 90° and 180°, preferably between 120° and 150° whereby in the locked condition the movable jaw contacts the adjacent cable surface and defines a gap between the end of the movable jaw and the end of the fixed jaw which, in the locked condition, is less than the median diameter of the cable.

5. A disconnectable overhead cable transport installation comprising at least one driven continuous run carrying/towing cable, at least one vehicle coupled to the cable through the intermediary of at least one disconnectable locking clamp and a deviating means located in a coupling/uncoupling area, the installation comprising a clamp having a fixed jaw including an internal support surface including a first cylindrical surface complementary to the cross-sectional shape of the cable so that in the unlocked condition the first surface contacts a first corresponding surface of the cable and a second surface which is an extension of the first cylindrical surface and which, in the locked condition is spaced from a second corresponding surface of the cable, wherein the deviating means acts exclusively in the vertical direction.

6. An installation according to claim 5, in which the deviating means is defined by the trajectory of the cable and the trajectory of at least one travelling rail which are inclined relative to each other in the vertical direction while remaining at a substantially constant distance from each other in the transverse horizontal direction.

7. An installation according to claim 5, in which the rollers engaged with the cable in the coupling/uncoupling area have a substantially horizontal transverse axis.

8. A transport installation with two overhead cables parallel to each other and driven at the same speed in a continuous run defined by end stations, pylons, and rollers and having at least one vehicle coupled to the cables by a suspension extending in the vertical plane of symmetry of the cables and articulated to a carriage mounting at least one pair of disconnectable clamps to lock the carriage on to the two cables from above and to uncouple the vehicle in the end stations by disconnecting the clamps, said clamps each having fixed and movable jaws with said fixed jaws being located inwardly of the cables when connected thereto and said movable jaws being located outwardly thereof, said fixed jaws having inner surfaces facing their associated cables and facing away from each other which define a transverse horizontal gap between them when on the two cables which is less than the normal horizontal transverse gap between the cables imposed by the fixed structure of the installation defined by the said pylons, rollers, and end stations.

9. An installation according to claim 8 having at least one unlocking/locking area, at least one coupling/uncoupling area, and at least one catching/releasing area, wherein the fixed structure of the installation is arranged in such a way that in the coupling/uncoupling area, the transverse horizontal gap between the two cables is substantially constant.

10. An installation according to claim 8, wherein each clamp of a carriage comprises a body mounting a fixed jaw and a movable jaw, the clamp being either normally in the connected position where it is rigidly locked with the cable from above, the jaws being flush with the lower surface of the cable in the locked position and presenting a small arc or projection relative to the upper part of the cable, or in the disconnected condition when it is no longer rigidly locked with the cable, the jaws then being in the unlocked position, the internal support surface of the fixed jaw of the clamp consisting, on the one hand, of a first cylindrical surface complementary to the cross-sectional shape of the cable so that, in the locked condition, the first surface contacts a first corresponding surface of the cable and, on the second hand, at the side of the end of the fixed jaw a second surface which is an extension of the first cylindrical surface and which, in the locked condition is spaced from a second corresponding surface of the cable.

11. An installation according to claim 10, in which said second surface of the fixed jaw of each clamp is, at least partly approximately flat, and is spaced from the second cable surface at least as much as a plane tangential to said second cable surface and which is preferably located in said plane.

12. An installation according to claim 10, in which the first cylindrical surface of the fixed jaw of each clamp is an arc of approximately 90°.

13. An installation according to claim 10, in which the internal support surface of the movable jaw of each clamp is of cylindrical section shape and is complementary to the cross-section of the cable, extending through an arc of between 90° and 180°, preferably between 120° and 150° so that in the locked condition the movable jaw contacts the adjacent cable surface, the gap between the end of the movable jaw and the end of the fixed jaw being, in the locked condition, below a median diameter of the cable.

14. An installation according to claim 10, wherein the spatial relationship between the two transverse gaps is greater than 90° and at most equal to 100°.

15. A method for disconnecting a clamp from a cable, said clamp being a disconnectable locking clamp for use with a carrier/towing cable for a transport installation having at least one overhead carrier/towing cable, to lock a vehicle rigidly to the cable from above and comprising a body having a fixed jaw and a movable jaw pivotally mounted thereon, the clamp being movable between a connected position wherein it is rigidly locked with the cable from above and the jaws are flush with the lower surface of the cable while presenting a small projection relative to the upper part of the cable and a disconnected condition wherein the clamp is not rigidly locked with the cable and its jaws are in an unlocked position; said fixed jaw having an internal support surface including a first cylindrical surface complementary to the cross-sectional shape of the cable so that, in the locked condition, the first surface contacts a first corresponding surface of the cable and a second surface which is an extension of the first cylindrical surface and which, in the locked condition, is spaced from a second corresponding surface of the cable, said method comprising the steps of unlocking the clamp, uncoupling the clamp from the cable so that all contact between the cable and the clamp is removed and the cable is no longer locked in the clamp, and releasing the cable from the clamp internal space defined between said jaws so that it can no longer interact with the cable wherein said uncoupling phase includes the step of moving the cable in relation to the clamp only in the vertical direction.

16. The method of claim 15 wherein said step of moving the cable in relation to the clamp only in the vertical direction comprises the step of moving the clamp vertically upwards with the cable maintaining its trajectory.

17. A method of connecting at least two clamps respectively to each of the cables of a transport installation with two overhead carrying/towing cables parallel to each other and driven at the same speed in a continuous run defined by end stations, pylons, and rollers and having at least one vehicle coupled to the cables by a suspension extending in the vertical plane of symmetry of the cables and articulated to a carriage mounting at least one pair of disconnectable clamps to lock the carriage on to the two cables from above and to uncouple the vehicle in the end stations by disconnecting the clamps, the transverse horizontal gap between the insides of the clamps locked on the two cables being less than the normal horizontal transverse gap between the cables imposed by the fixed structure of the installation defined by the said pylons, guide rollers and end stations wherein, in a coupling phase the cables and the unlocked clamps are moved in relation to each other exclusively in the vertical direction to associate the clamps with the cables by establishing contact between the clamps and the upper parts of the cables.

18. A method according to claim 17, characterized by the fact that in a later locking phase, each of the clamps is locked round the corresponding cable in two stages: a first stage when the internal support surface of the movable jaw of each of the clamps comes into contact with the side surface of the respective corresponding cable and a second stage when the movable jaw urges the cable against the fixed jaw imposing a slight change of position of the cable in relation to the fixed jaw in the transverse horizontal direction, and thus a slight transverse horizontal approachment of the two cables, the clamps then being locked to the cables.

19. A method of disconnecting at least two clamps mounted on a vehicle respectively to each of the cables of a transport installation with two overhead carrying/-towing cables, parallel to each other and driven at the same speed in a continuous run defined by end stations, pylons, and rollers and having at least one vehicle coupled to the cables by a suspension extending in the vertical plane of symmetry of the cables and articulated to a carriage mounting at least one pair of disconnectable clamps to lock the carriage on to the two cables from above and to uncouple the vehicle in the end stations by disconnecting the clamps, the transverse horizontal gap between the insides of the clamps locked on the two cables being less than the normal horizontal transverse gap between the cables imposed by the fixed structure of the installation defined by the said pylons, rollers and end stations, wherein on unlocking of the clamps from the locked state where they are locked with the cables, the movable jaw of each of the clamps is spaced from its respective cable following which both cables return resiliently to their normal spacing imposed by the fixed structure of the installation which is slightly greater than the transverse gap between the clamps, and thus creates a spacing between, on the one hand, the cables, and on the other hand, the fixed jaws and the clamps.

* * * * *

UNITED STATES PATENT AND TRADEMARK OFFICE

CERTIFICATE OF CORRECTION

PATENT NO. : 4,741,272

DATED : May 3, 1988

INVENTOR(S) : Serge Tarassoff

It is certified that error appears in the above-identified patent and that said Letters Patent is hereby corrected as shown below:

Column 5, line 39, change "t his" to --this--;
Column 5, line 55, change "fetures" to --features--;
Column 8, line 6, change "adn" to --and--;
Column 8, line 15, change "structore" to --structure--;
Column 8, line 32, change "coupling, uncoupling" to --coupling/uncoupling--;
Column 8, line 40, change "eentually" to --eventually--;
Column 10, line 27, delete the comma (,) after "is";
Column 10, line 28, delete the comma (,) after "flat"; and
Column 11, line 68, change "90°" to --90%-- and "100°" to --100%--.

Signed and Sealed this

Twenty-seventh Day of September, 1988

*Attest:*

DONALD J. QUIGG

*Attesting Officer*

*Commissioner of Patents and Trademarks*